US009050508B2

(12) United States Patent
Kitagawa

(10) Patent No.: US 9,050,508 B2
(45) Date of Patent: Jun. 9, 2015

(54) GOLF CLUB AND METHOD FOR ADJUSTING CHARACTERISTICS OF THE SAME

(71) Applicant: BRIDGESTONE SPORTS CO., LTD, Tokyo (JP)

(72) Inventor: Tomonori Kitagawa, Tokyo (JP)

(73) Assignee: BRIDGESTONE SPORTS CO., LTD, Tokyo (JP)

( * ) Notice: Subject to any disclaimer, the term of this patent is extended or adjusted under 35 U.S.C. 154(b) by 0 days.

(21) Appl. No.: 14/097,895

(22) Filed: Dec. 5, 2013

(65) Prior Publication Data

US 2014/0162805 A1 Jun. 12, 2014

(30) Foreign Application Priority Data

Dec. 7, 2012 (JP) ..... 2012-268434

(51) Int. Cl.
*A63B 53/02* (2006.01)
*A63B 53/06* (2006.01)
*A63B 53/04* (2006.01)

(52) U.S. Cl.
CPC ..... *A63B 53/02* (2013.01); *A63B 2053/023* (2013.01); *A63B 53/0466* (2013.01); *A63B 2053/0491* (2013.01)

(58) Field of Classification Search
CPC ... A63B 53/02; A63B 53/16; A63B 2053/027
USPC ..... 473/239, 244–248, 307, 309, 296
See application file for complete search history.

(56) References Cited

U.S. PATENT DOCUMENTS

| | | | | |
|---|---|---|---|---|
| 7,931,542 | B2 * | 4/2011 | Kusumoto | 473/288 |
| 7,997,997 | B2 * | 8/2011 | Bennett et al. | 473/288 |
| 8,235,837 | B2 * | 8/2012 | Bennett et al. | 473/307 |
| 8,272,972 | B2 * | 9/2012 | Sato et al. | 473/296 |
| 8,382,607 | B2 * | 2/2013 | Burnett et al. | 473/307 |
| 8,517,856 | B2 * | 8/2013 | Bennett et al. | 473/307 |
| 8,696,488 | B2 * | 4/2014 | Burnett et al. | 473/307 |
| 8,852,020 | B2 * | 10/2014 | Bennett et al. | 473/296 |
| 8,936,514 | B2 * | 1/2015 | Sato | 473/296 |
| 2009/0062029 | A1 * | 3/2009 | Stites et al. | 473/288 |
| 2010/0016094 | A1 * | 1/2010 | Hocknell et al. | 473/288 |
| 2014/0051527 | A1 * | 2/2014 | Sato | 473/307 |
| 2014/0162806 | A1 * | 6/2014 | Kitagawa et al. | 473/307 |

FOREIGN PATENT DOCUMENTS

JP 2012-165864 A 9/2012

* cited by examiner

*Primary Examiner* — Stephen Blau
(74) *Attorney, Agent, or Firm* — Sughrue Mion, PLLC

(57) ABSTRACT

A golf club includes: a shaft; a head; and a shaft case, a hosel column, wherein: the shaft case includes a convex axis member provided at a top end of the shaft case; the hosel column includes a plurality of concave threads that are provided on the lower side of a step face on an inner periphery of the hosel column; a flange member is provided at a back end of the shaft case, and a spacer is provided insertable and removable between the flange member and an upper end of the hosel column; a bolt holder is arranged to connect with the step face when the spacer is inserted between the flange member of the shaft case and the hosel column; and the bolt holder is arranged to connect with the upper ends of the concave threads when the spacer is removed.

10 Claims, 14 Drawing Sheets

GOLF CLUB AND METHOD FOR ADJUSTING CHARACTERISTICS OF THE SAME

BACKGROUND

1. Field of the Invention

The present invention relates to golf clubs, and in particular, relates to a golf club of which characteristics such as a lie angle, a slice angle, and a progression can be easily adjusted. In addition, the present invention relates to methods for adjusting the characteristics of the golf club.

2. Description of the Related Art

A golf club includes a shaft, and a head attached to a top end portion of the shaft. A grip is attached to a base end portion of the shaft.

A conventional general golf club head includes a hosel hole that is directly provided to the head, and a shaft is inserted into and bonded to the hosel hole with an adhesive agent. An epoxide-based adhesive agent is generally used for the adhesive agent. In making a shaft change, the hosel portion is heated to destroy the structure made from the cured epoxy resin, and thereby the shaft can be pulled out of the hosel hole.

The conventional general golf club head having this configuration has a lot of trouble in making a shaft change. In addition, characteristics such as a lie angle, a slice angle, and a progression of the golf club head cannot be adjusted.

JP-A-2012-165864 describes a golf club that allows a shaft change to be easily made, and of which characteristics such as a lie angle, a slice angle, and a progression can be adjusted, and describes a method for adjusting the characteristics of the golf club. The golf club head of JP-A-2012-165864 has a configuration such that a shaft case having an approximately cylindrical shape is bonded to the top end of a shaft, the shaft case is inserted into a cylinder portion of a hosel, a divider is provided to a lower portion of the cylinder portion, a spacer is provided between the top end of the shaft case and the divider, the shaft case is engaged in the spacer so as not to be rotatable, a stopper member arranged to prevent the spacer from rotating is provided between the spacer and the divider, and a bolt that is inserted into a bolt through hole provided to the divider and a bolt through hole provided to the spacer from a sole side of the head is screwed into the shaft case, and thereby the shaft case is fixed to the head.

In the golf club of JP-A-2012-165864, loosening and unbolting the bolt allows the shaft case to be pulled out of the cylinder portion of the hosel. Thus, for example, when a shaft case having a configuration such that the axis center of the shaft is inclined in a slanting direction (e.g., an oblique direction) with respect to the axis center of an insert hole of the shaft case is used, changing the phase of a circumferential direction of the shaft case changes an attaching direction of the shaft with respect to a head main body, and thereby a lie angle and a slice angle are changed.

In addition, when a shaft case having a configuration such that the axis center of the shaft is inclined in a slanting direction (e.g., an oblique direction) with respect to the axis center of an insert hole of the shaft case is used, changing the phase of a circumferential direction of the shaft case changes an attaching direction of the shaft with respect to a head main body, and thereby a lie angle and a slice angle are changed.

Thus, only the lie angle and the slice angle can be adjusted in the golf club having the identical shaft and the identical head main body.

In addition, when a shaft case having a shape such that an axis center position of an insert hole of the shaft case is displaced in a parallel translation manner from an axis center position of an insert hole of a hosel is used, changing the phase of a circumferential direction of the shaft case allows a progression and the distance between a shaft and the center of gravity (the center of gravity distance) to be adjusted in the golf club having the identical shaft and the identical head main body.

In JP-A-2012-165864, a shaft case of a pattern identical to the shaft case is prepared as a shaft case, and a shaft with other characteristics is bonded to the prepared shaft case to prepare a shaft case-shaft connected body, and by replacing the previously-used shaft case-shaft connected body with the prepared shaft case-shaft connected body to attach to the hosel of the head, the golf club having the different shaft can be obtained.

In the golf club of JP-A-2012-165864 described above, an insertion depth of the shaft case into a hosel column cannot be changed.

SUMMARY

An object of the present invention is to provide a golf club that allows a shaft change to be easily made, of which characteristics such as a lie angle, a slice angle, and a progression can be adjusted, and of which an insertion depth of a shaft case into a hosel column can be changed, and to provide a method for adjusting the characteristics of the golf club.

According to a first aspect of the invention, there is provided a golf club including: a shaft; a head attached to a top end of the shaft; and a shaft case having an approximately cylindrical shape, and including a shaft insertion hole which the top end of the shaft is inserted into and bonded to, an axis center of an outer periphery of the shaft case and an axis center of the shaft being in a non-coaxial state, the shaft case being inserted into an inner hole of a hosel column of the head, the shaft case being fixed to the hosel column with a bolt, wherein: the shaft case includes a convex axis member provided at a top end of the shaft case, the convex axis member including a female screw hole and a first engaging member that is provided on an outer periphery of the convex axis member; the inner hole of the hosel column has a diameter that is larger on a lower side of a step face that is provided at some midpoint in an axis center direction of the inner hole than at the step face; the hosel column includes a plurality of concave threads that are provided on the lower side of the step face on an inner periphery of the hosel column, and extend to a lower end of the hosel column, upper ends of some of the plurality of concave threads being disposed lower than the step face; a bolt holder having a cylindrical shape is provided at a lower portion of the inner hole of the hosel column, the bolt holder being arranged to connect with either one of the step face and the upper ends of the concave threads; the bolt is disposed within the bolt holder; a reduced-diameter face is provided at some midpoint in an up and down direction inside of the bolt holder, and the inside of the bolt holder has a diameter that is larger on a lower side of the reduced-diameter face than on an upper side of the reduced-diameter face; a head portion of the bolt is in contact with the reduced-diameter face from the lower side, and a threaded shaft portion of the bolt extends upper than the step face to screw into the female screw hole; a second engaging member is provided on the upper side of the reduced-diameter face on an inner periphery of the bolt holder, the second engaging member being arranged to be engaged with the first engaging member to prevent the shaft case from rotating; a flange member is provided at a back end of the shaft case, and a spacer is provided insertable and removable between the flange member and an upper end of the hosel column; the bolt holder is arranged to connect with the step face when the spacer is inserted between the flange member of the shaft case and the hosel column; and the bolt holder is arranged to connect with the upper ends of the concave threads when the spacer is removed.

The concave threads may include a plurality of concave threads, of which positions of upper ends in an axis center line direction of the hosel column are different from each other.

Convex corner portions may be provided on an outer periphery of the bolt holder, the convex corner portions being arranged to be engaged with either one of the step face and the upper ends of the concave threads.

The axis center of the shaft may be in a slanting direction with respect to the axis center of the outer periphery of the shaft case.

The axis center of the shaft may be parallel to the axis center of the outer periphery of the shaft case.

The head may include a weight member provided on a heel side of the head.

According to a second aspect of the invention, there is provided a method for adjusting characteristics of a golf club including: a shaft; a head attached to a top end of the shaft; and a shaft case having an approximately cylindrical shape, and including a shaft insertion hole which the top end of the shaft is inserted into and bonded to, an axis center of an outer periphery of the shaft case and an axis center of the shaft being in a non-coaxial state, the shaft case being inserted into an inner hole of a hosel column of the head, the shaft case being fixed to the hosel column with a bolt, wherein: the shaft case includes a convex axis member provided at a top end of the shaft case, the convex axis member including a female screw hole and a first engaging member that is provided on an outer periphery of the convex axis member; the inner hole of the hosel column has a diameter that is larger on a lower side of a step face that is provided at some midpoint in an axis center direction of the inner hole than at the step face; the hosel column includes a plurality of concave threads that are provided on the lower side of the step face on an inner periphery of the hosel column, and extend to a lower end of the hosel column, upper ends of some of the plurality of concave threads being disposed lower than the step face; a bolt holder having a cylindrical shape is provided at a lower portion of the inner hole of the hosel column, the bolt holder being arranged to connect with either one of the step face and the upper ends of the concave threads; the bolt is disposed within the bolt holder; a reduced-diameter face is provided at some midpoint in an up and down direction inside of the bolt holder, and the inside of the bolt holder has a diameter that is larger on a lower side of the reduced-diameter face than on an upper side of the reduced-diameter face; a head portion of the bolt is in contact with the reduced-diameter face from the lower side, and a threaded shaft portion of the bolt extends upper than the step face to screw into the female screw hole; a second engaging member is provided on the upper side of the reduced-diameter face on an inner periphery of the bolt holder, the second engaging member being arranged to be engaged with the first engaging member to prevent the shaft case from rotating; a flange member is provided at a back end of the shaft case, and a spacer is provided insertable and removable between the flange member and an upper end of the hosel column; the bolt holder is arranged to connect with the step face when the spacer is inserted between the flange member of the shaft case and the hosel column; and the bolt holder is arranged to connect with the upper ends of the concave threads when the spacer is removed, the method including: unbolting the bolt to disengage the first engaging member of the convex axis member of the shaft case from the second engaging member of the bolt holder; rotating the shaft case, and then changing any one of a position of the shaft insertion hole and an inclination of the shaft; engaging again the first engaging member of the shaft case with the second engaging member; and fixing the shaft case with the bolt.

According to a third aspect of the invention, there is provided a method for adjusting characteristics of a golf club including: a shaft; a head attached to a top end of the shaft; and a shaft case having an approximately cylindrical shape, and including a shaft insertion hole which the top end of the shaft is inserted into and bonded to, an axis center of an outer periphery of the shaft case and an axis center of the shaft being in a non-coaxial state, the shaft case being inserted into an inner hole of a hosel column of the head, the shaft case being fixed to the hosel column with a bolt, wherein: the shaft case includes a convex axis member provided at a top end of the shaft case, the convex axis member including a female screw hole and a first engaging member that is provided on an outer periphery of the convex axis member; the inner hole of the hosel column has a diameter that is larger on a lower side of a step face that is provided at some midpoint in an axis center direction of the inner hole than at the step face; the hosel column includes a plurality of concave threads that are provided on the lower side of the step face on an inner periphery of the hosel column, and extend to a lower end of the hosel column, upper ends of some of the plurality of concave threads being disposed lower than the step face; a bolt holder having a cylindrical shape is provided at a lower portion of the inner hole of the hosel column, the bolt holder being arranged to connect with either one of the step face and the upper ends of the concave threads; the bolt is disposed within the bolt holder; a reduced-diameter face is provided at some midpoint in an up and down direction inside of the bolt holder, and the inside of the bolt holder has a diameter that is larger on a lower side of the reduced-diameter face than on an upper side of the reduced-diameter face; a head portion of the bolt is in contact with the reduced-diameter face from the lower side, and a threaded shaft portion of the bolt extends upper than the step face to screw into the female screw hole; a second engaging member is provided on the upper side of the reduced-diameter face on an inner periphery of the bolt holder, the second engaging member being arranged to be engaged with the first engaging member to prevent the shaft case from rotating; a flange member is provided at a back end of the shaft case, and a spacer is provided insertable and removable between the flange member and an upper end of the hosel column; the bolt holder is arranged to connect with the step face when the spacer is inserted between the flange member of the shaft case and the hosel column; and the bolt holder is arranged to connect with the upper ends of the concave threads when the spacer is removed, the method including: unbolting the bolt to rotate the bolt holder to change an insertion depth of the bolt holder; and fixing again the shaft case with the bolt.

According to a fourth aspect of the invention, there is provided a method for replacing a shaft of a golf club with another shaft to adjust characteristics of the golf club, the golf club including: the shaft; a head attached to a top end of the shaft; and a shaft case having an approximately cylindrical shape, and including a shaft insertion hole which the top end of the shaft is inserted into and bonded to, an axis center of an outer periphery of the shaft case and an axis center of the shaft being in a non-coaxial state, the shaft case being inserted into an inner hole of a hosel column of the head, the shaft case being fixed to the hosel column with a bolt, wherein: the shaft case includes a convex axis member provided at a top end of the shaft case, the convex axis member including a female screw hole and a first engaging member that is provided on an outer periphery of the convex axis member; the inner hole of the hosel column has a diameter that is larger on a lower side of a step face that is provided at some midpoint in an axis center direction of the inner hole than at the step face; the hosel column includes a plurality of concave threads that are provided on the lower side of the step face on an inner periphery of the hosel column, and extend to a lower end of the hosel column, upper ends of some of the plurality of concave threads being disposed lower than the step face; a bolt holder having a cylindrical shape is provided at a lower portion of the inner hole of the hosel column, the bolt holder being arranged to connect with either one of the step face and the upper ends of the concave threads; the bolt is disposed within the bolt holder; a reduced-diameter face is provided at some midpoint in an up and down direction inside of the bolt holder, and the inside of the bolt holder has a diameter that is larger on a lower side of the reduced-diameter face than on an upper side of the reduced-diameter face; a head portion of the bolt is in contact with the reduced-diameter face from the lower side, and a threaded shaft portion of the bolt extends upper than the step face to screw into the female screw hole; a second engaging member is provided on the upper side of the reduced-diameter face on an inner periphery of the bolt holder, the second engaging member being arranged to be engaged with the first engaging member to prevent the shaft case from rotating; a flange member is provided at a back end of the shaft case, and a spacer is provided insertable and removable between the flange member and an upper end of the hosel column; the bolt holder is arranged to connect with the step face when the spacer is inserted between the flange member of the shaft case and the hosel column; and the bolt holder is arranged to connect with the upper ends of the concave threads when the spacer is removed, the method comprising: bonding in advance the another shaft to another shaft case to produce another shaft case-shaft connected body; removing the shaft case-shaft connected body that is attached to the golf club from the head; and attaching the other shaft case-shaft connected body to the head.

In the golf club according to the present invention, the shaft case is inserted in the hosel column, and is fixed by the bolt that is held by the bolt holder inserted from a sole side. The convex corner portions of the bolt holder are engaged with the step face of the hosel column or the upper ends of the concave threads, so that the insertion depth of the bolt holder is changeable. The bolt holder and the shaft case are prevented from rotating due to the engagement between the first engaging member and the second engaging member. Changing the engaging position of the bolt holder with the hosel column, and changing or removing the spacer of the hosel column allow the insertion depth of the shaft into the hosel column to be changed.

In the golf club according to the present invention, the convex corner portions of the bolt holder are engaged with the concave threads of the hosel column. In addition, the first engaging member of the convex axis member is engaged with the second engaging member of the bolt holder, so that positioning in a circumferential direction of the shaft case can be effected.

In the golf club according to the present invention, when the bolt is loosened and unbolted, the convex axis member of the shaft case can be pulled out of the second engaging member, and the shaft case can be rotated in the circumferential direction to have its orientation (the phase of the circumferential direction) changed. Thus, for example, when a shaft case having a configuration such that the axis center of the shaft is inclined in a slanting direction (e.g., an oblique direction) with respect to the axis center of an outer periphery of the shaft case is used, changing the phase of the circumferential direction of the shaft case changes an attaching direction of the shaft with respect to a head main body, and thereby a lie angle and a slice angle are changed. Thus, only the lie angle and the slice angle can be adjusted in the golf club having the identical shaft and the identical head main body.

In addition, when a shaft case having a shape such that the axis center of the shaft is displaced in a parallel translation manner from the axis center of the outer periphery of the shaft case is used, changing the phase of a circumferential direction of the shaft case allows a progression and the distance between the shaft and the center of gravity (the center of gravity distance) to be adjusted in the golf club having the identical shaft and the identical head main body.

In the present invention, a shaft case of a pattern identical to the shaft case is prepared as a shaft case, and a shaft with other characteristics is bonded to the prepared shaft case to prepare a shaft case-shaft connected body, and by replacing the previously-used shaft case-shaft connected body with the prepared shaft case-shaft connected body to attach to the hosel of the head, the golf club having the different shaft can be obtained.

Thus, according to the present invention, troubles of destroying a structure made from an adhesive agent by heat, pulling out a shaft, and attaching another shaft with an adhesive agent again as done conventionally can be avoided, and the time taken to do these steps can be saved. Thus, a golf club that has just been used for a trial shot can be used for another trial shot immediately after promptly changing an insertion depth of a shaft, a lie angle, a slice angle, a progression, or the distance between the shaft and the center of gravity distance. In addition, a golf club that has just been used for a trial shot can be used for another trial shot immediately after removing a shaft case-shaft connected body from a head and attaching another shaft case-shaft connected body that has other shaft characteristics to the head. In this manner, golfers can find appropriate golf clubs very easily at golf shops. In addition, evaluations of shafts can be made without consideration of differences between heads.

These years, in order that golfers could search golf clubs that are suited to their skill levels, systems for searching a golf club that matches the golfer with the use of a computer or a high-speed camera have been developed. These systems are arranged to search a suited golf club by comparing commercial golf clubs based on head speeds or launch angles.

Meanwhile, according to the present invention, an insertion depth of a shaft, a lie angle, a slice angle, the center of gravity distance, or a progression can be changed in the golf club having the identical shaft and the identical head, and differences between the characteristics (launch angles and spins) of the flying balls that are launched can be easily realized. In addition, only shafts can be exchanged on the identical head, so that differences between only the shafts can be realized. In addition, shafts can be exchanged, or a lie angle, a slice angle, or a progression can be adjusted without exchanging shafts depending on the conditions of a player on the day.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1A:
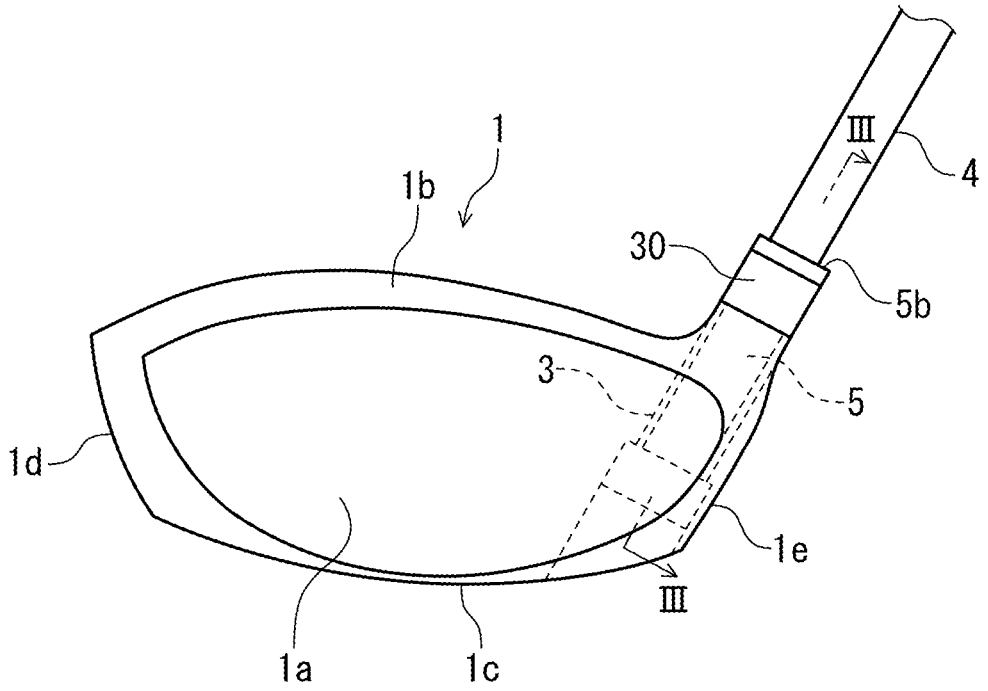
FIG. 1A is a front view of a head according to an embodiment of the present invention.
Figure 1B:
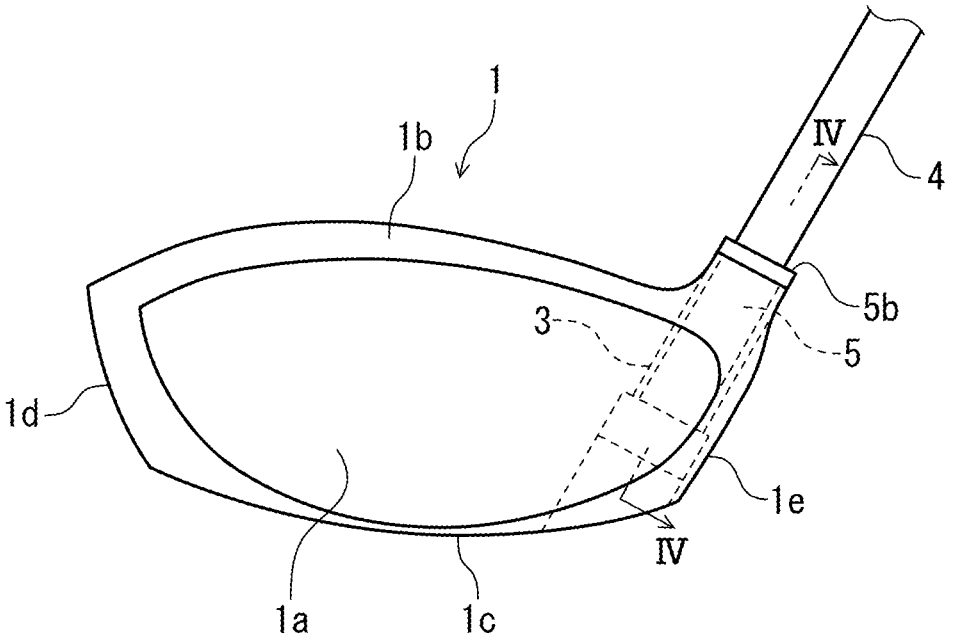
FIG. 1B is a front view of the head from which a second spline ring is removed.
Figure 2:
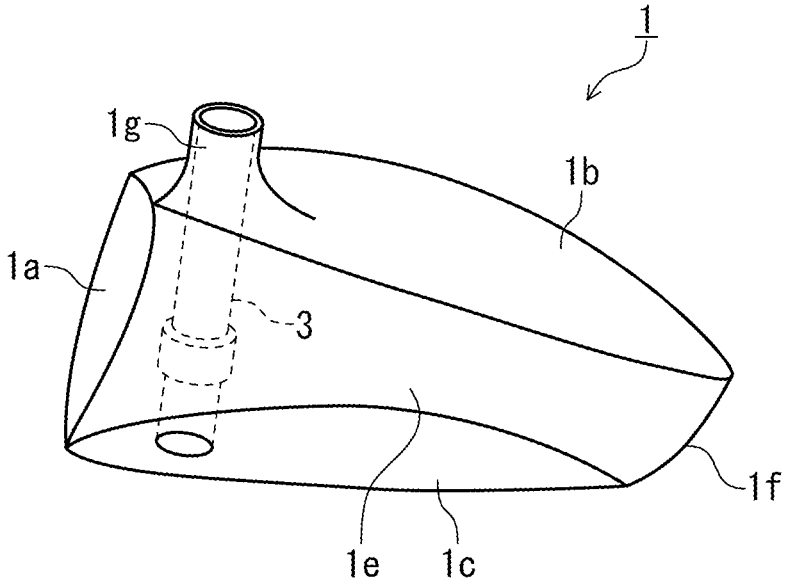
FIG. 2 is a side view of the head shown from a heel side.

Hereinafter, a description of embodiments of the present invention will be provided with reference to FIGS. 1A to 8.

This golf club has a configuration such that a shaft 4 is attached to a hosel column 3 of a head 1 via a shaft case 5, a bolt holder 8, and a bolt 7.

The head 1 is a hollow wood-type head, and includes a face portion 1*a*, a crown portion 1*b*, a sole portion 1*c*, a toe portion 1*d*, a heel portion 1*e*, a back portion 1*f*, and a hosel portion 1*g*.

Figure 3:
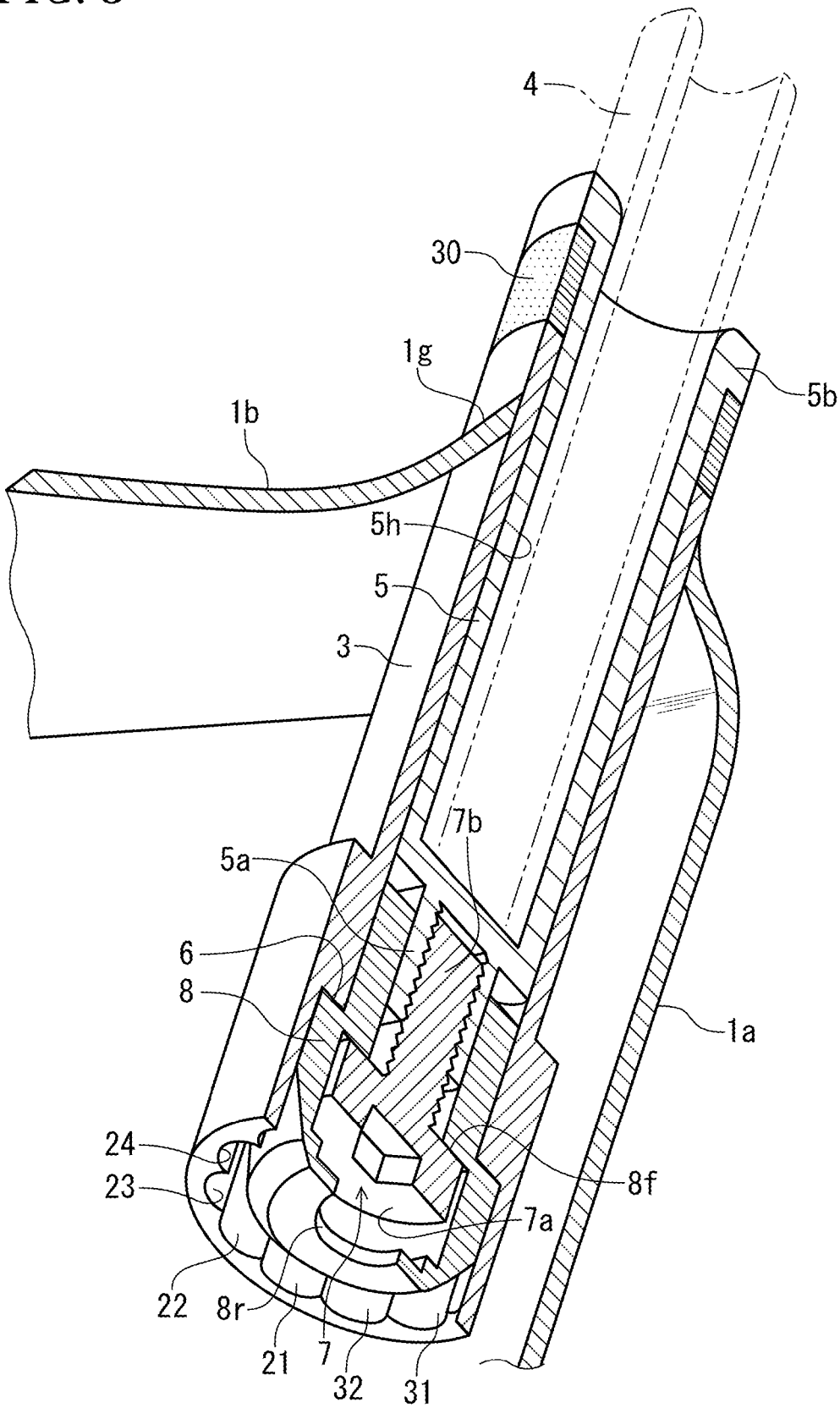
FIG. 3 is a perspective cross-sectional view taken along the line of FIG. 1.

As shown in FIG. 3, the hosel portion 1*g* is provided on the crown portion 1*b* on the side of the face portion 1*a* and on the side of the heel portion 1*e*. The hosel column 3 is connected to the hosel portion 1*g*, and extends toward the sole portion 1*c*. The hosel column 3 has an approximately cylindrical pipe shape, and includes an inner hole 3*h* (FIGS. 5 and 6) on which a step face 6 is provided at some midpoint in a longitudinal direction (an axis center direction) of the inner hole 3*h*, the step face 6 being vertical to the axis center direction. The inner hole 3*h* has a cylindrical shape having a smaller diameter on the upper side of the step face 6, and having a larger diameter on the lower side of the step face 6.

Twelve concave threads 21 to 32 extending in an axis center line direction of the hosel column 3 are provided on an inner periphery of the larger-diameter hole portion on the lower side of the step face 6. Each of the concave threads 21 to 32 has an arc shape in cross section vertical to the axis center line of the hosel column 3. Each of the concave threads 21 to 32 has a width in a circumferential direction, of which a central angle with respect to the axis center of the hosel column 3 is 30 degrees.

Figure 7A:
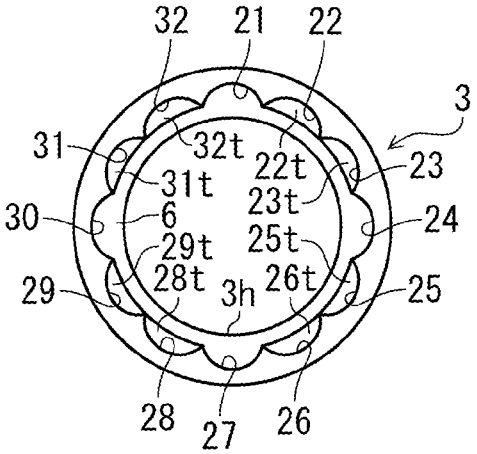
FIG. 7A is a bottom view of a hosel column.

The concave threads 21 to 32 are arranged in this order in the circumferential direction on the inner periphery of the hosel column 3 as shown in FIG. 7A. The concave threads 21, 24, 27, and 30 extend from the step face 6 to the lower end of the hosel column 3. The concave threads 22, 25, 28, and 31 extend from positions lower than the step face 6 to the lower end of the hosel column 3. The concave threads 23, 26, 29, and 32 extend from positions that are between the concave threads 22, 25, 28, and 31 and the step face 6 to the lower end of the hosel column 3. The distance in the axis center direction from the step face 6 to upper ends 23*t*, 26*t*, 29*t*, and 32*t* of the concave threads 23, 26, 29, and 32 is equal to the distance in the axis center direction from the concave thread upper ends 23*t*, 26*t*, 29*t*, and 32*t* to upper ends 22*t*, 25*t*, 28*t*, and 31*t* of the concave threads 22, 25, 28, and 31.

Figure 5A:
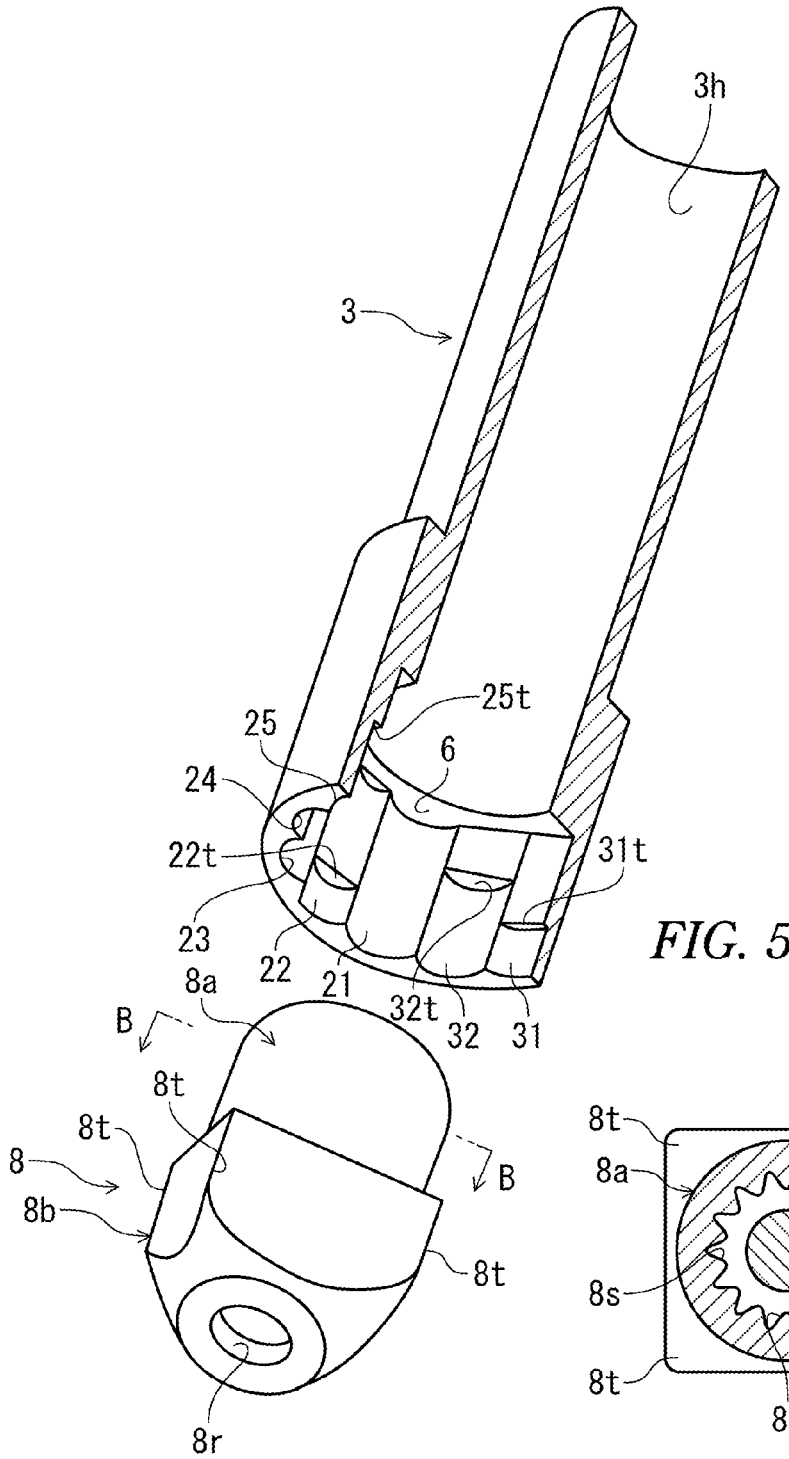
FIG. 5A is an exploded perspective cross-sectional view of a hosel.
Figure 5B:
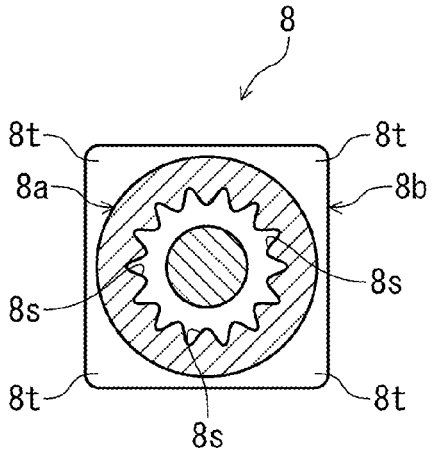
FIG. 5B is a cross-sectional view taken along the line B-B of FIG. 5A.

The bolt holder 8 holding the bolt 7 is fit into a lower portion of the hosel column 3 from below. The bolt holder 8 includes an upper cylindrical portion 8*a* of which an outer periphery has a cylindrical shape, and a rectangular cylindrical portion 8*b* that is disposed below the upper cylindrical portion 8*a* and of a monolithic construction with the upper cylindrical portion 8*a* as shown in FIG. 5A. The upper cylindrical portion 8*a* has an outer diameter that is slightly smaller than the inner diameter of the inner hole 3*h* of the hosel column 3.

An outer periphery of the rectangular cylindrical portion 8*b* has a rectangular cylindrical shape including convex corner portions 8*t* that jut in a radiation four directions farther than the outer periphery of the upper cylindrical portion 8*a*, and has a square shape in cross section vertical to a cylinder axis center line.

Figure 7B:
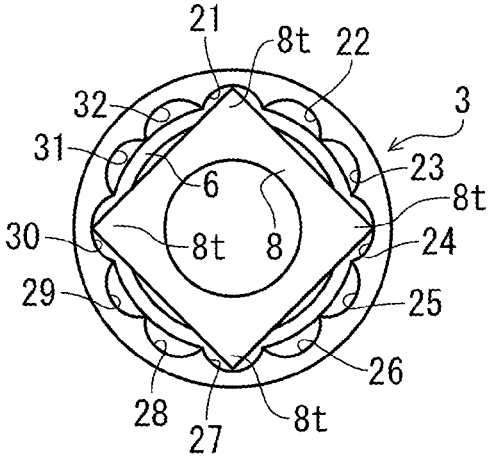
FIGS. 7B, 7C, and 7D are bottom views of the hosel column into which a bolt holder is inserted.
Figure 7C:
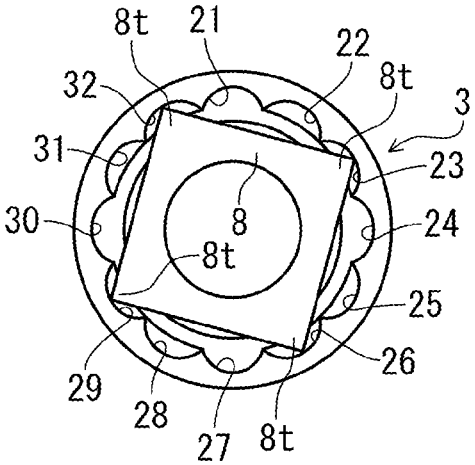
Figure 7D:
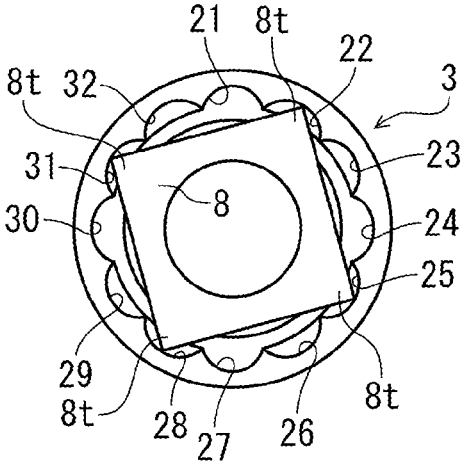

The length between the convex corner portions 8*t* and 8*t* in a diagonal direction of the square is slightly smaller than the length between the concave thread bottoms of the concave threads that face each other in a diametrical direction (e.g., the concave threads 21 and 27). Having this configuration, the bolt holder 8 can be brought into a deepest insertion state where the convex corner portions 8*t* get in the concave threads 21, 24, 27, and 30 to be brought into contact with the step surface 6 as shown in FIG. 7B, into an intermediate insertion state where the convex corner portions 8*t* get in the concave threads 23, 26, 29, and 32 to be brought into contact with the concave thread upper ends 23*t*, 26*t*, 29*t*, and 32*t* as shown in FIG. 7C, or into a shallowest insertion state where the convex corner portions 8*t* get in the concave threads 22, 25, 28, and 31 to be brought into contact with the concave thread upper ends 22*t*, 25*t*, 28*t*, and 31*t* as shown in FIG. 7D.

A reduced-diameter face 8*f* that has the shape of a step facing downward is provided at some midpoint in an axis center line direction on an inner hole of the bolt holder 8 (FIGS. 3 and 4), and the inner hole of the bolt holder 8 has a diameter that is smaller on an upper side of the reduced-diameter face 8*f* than on a lower side of the reduced-diameter face 8*f*. Splines 8*s* that define a second engaging member are provided on the upper side of the reduced-diameter face 8*f* on an inner periphery of the bolt holder 8 (FIG. 5A). The splines 8*s* extend in a direction parallel to an axis center line of the bolt holder 8.

The bolt 7 is installed in the bolt holder 8 with its head portion 7*a* disposed lower than the reduced-diameter face 8*f* and with its threaded shaft portion 7*e* extending upper than the reduced-diameter face 8*f*. An opening 8*r* through which rotational manipulation of the bolt 7 is made is provided on a lower end face of the bolt holder 8.

The shaft case 5 defines a cylindrical-shaped member having an outer diameter that is slightly smaller than the inner diameter of the hosel column 3, and includes an insertion hole 5*h* for the shaft 4 that is provided from the upper end side to the lower end side. The shaft 4 is inserted into the insertion hole 5*h* and bonded to the shaft case 5 with an adhesive agent. It is preferable that the insertion hole 5*h* have a depth equal to or more than 10 mm, for example, a depth of 10 to 50 mm, and in particular, it is preferable that the insertion hole 5*h* have a depth of 20 to 40 mm.

Figure 8:
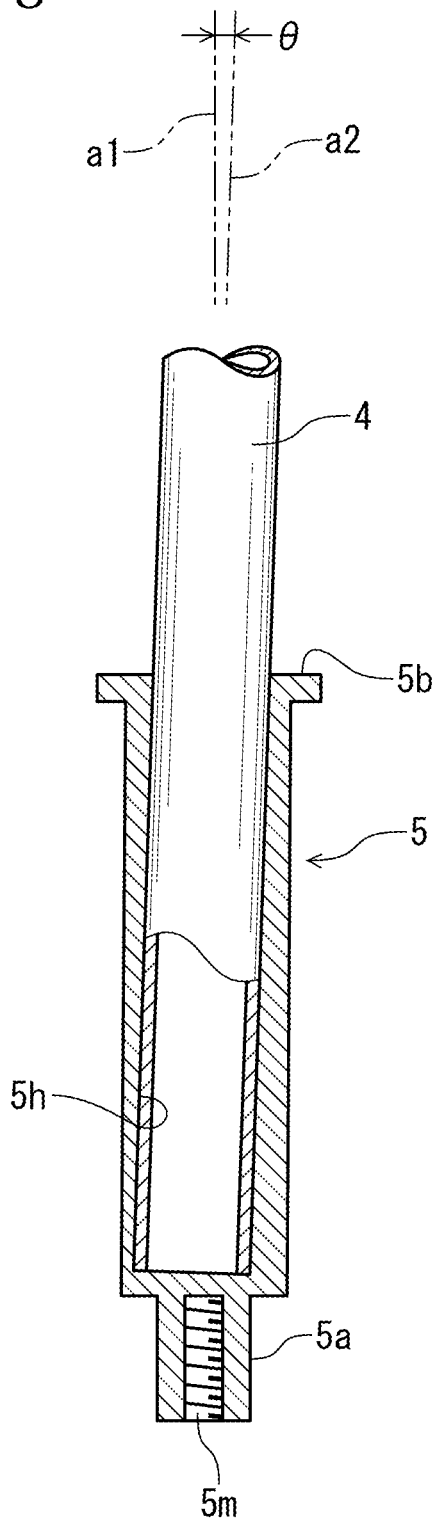
FIG. 8 is a cross-sectional view of the shaft case.

In the present embodiment, the axis center of the shaft insertion hole 5*h* is oblique to the axis center of an outer periphery of the shaft case 5 as shown in FIG. 8.

A flange member 5*b* that has the shape of a guard extending outward is provided at an upper end (back end) of the shaft case 5. The flange member 5*b* has the shape of an annular disk; however, it is also preferable that the flange member 5*b* have a tapered shape such that the flange member 5*b* is reduced in diameter more toward the top end of the flange member 5*b*, while the present invention is not limited to these configurations. A spacer 30 having a cylindrical shape is externally fit insertable and removable to an upper portion the shaft case 5, and sandwiched between the flange member 5*b* and an upper end face of the hosel column 3 as shown in FIGS. 1A and 3. The ring-shaped spacer 30 shown in the drawings is a spacer that is longer in a ring axis center line direction. A spacer that is half the length of the spacer 30 in a ring axis center line direction and not shown in the drawings is sold together with the golf club.

A convex axis member 5*a* is provided so as to project at a lower end portion (top end portion) of the shaft case 5. The convex axis member 5*a* shares the axis center with the outer periphery of the shaft case 5. A female screw hole 5*m* is provided to the convex axis member 5*a* in the axis center line direction from a top end face of the convex axis member 5*a*.

Splines 5*s* (convex threads in a direction parallel to the axis center line) that define a first engaging member are provided on an outer periphery of the convex axis member 5*a*. The splines 5*s* are arranged to mesh with the second splines 8*s* of the bolt holder 8.

In order to assemble the golf club, the shaft case 5 is bonded in advance to the top end of the shaft 4 with an adhesive agent to prepare a shaft case-shaft connected body. It is preferable that the adhesive agent be applied onto the outer periphery at the top end portion of the shaft 4, and the shaft 4 be inserted into the deepest recess of the shaft insertion hole 5*h* of the shaft case 5. An epoxide-based adhesive agent is preferably used for the adhesive agent.

Figure 4:
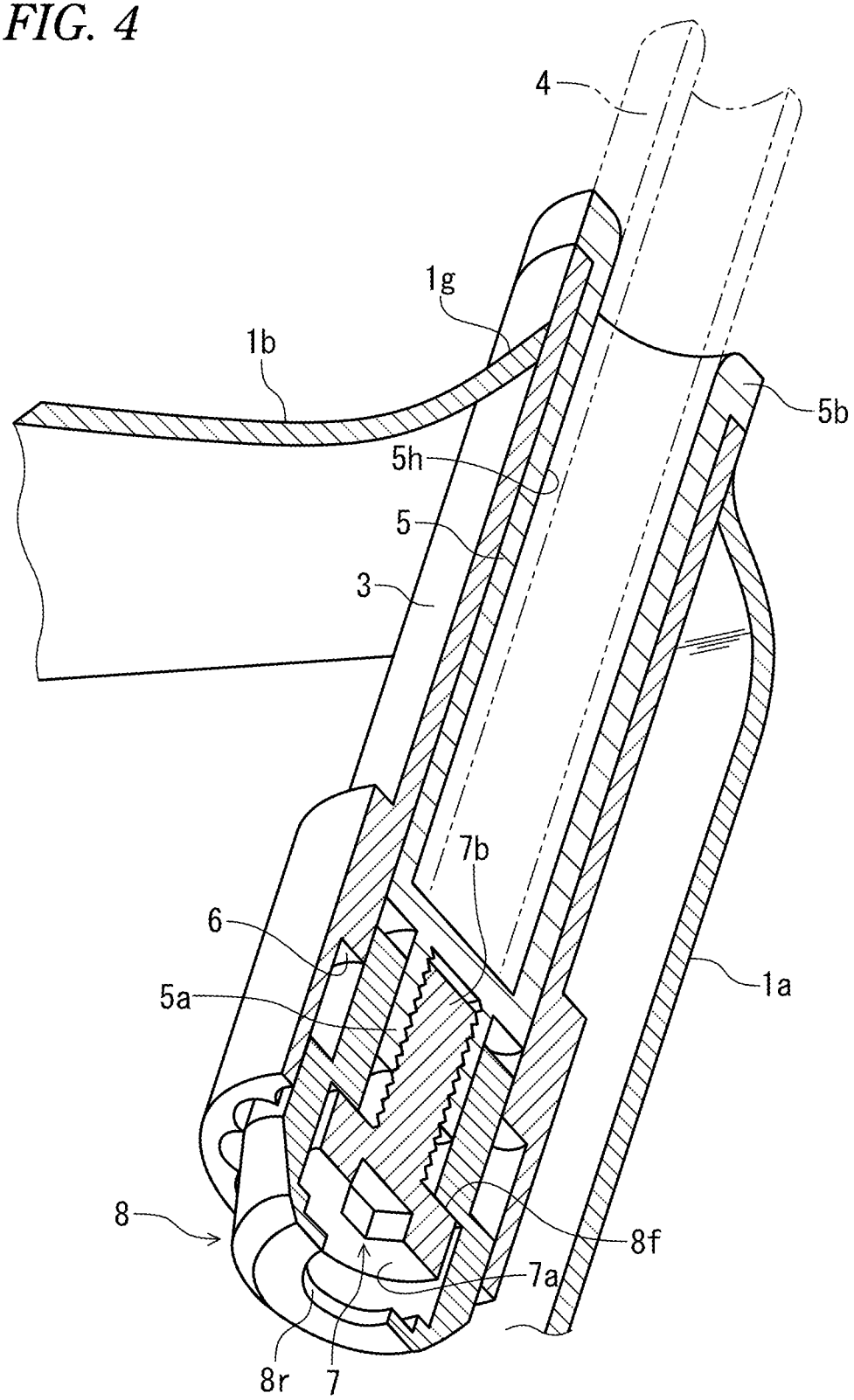
FIG. 4 is a perspective cross-sectional view taken along the line IV-IV of FIG. 1.
Figure 6A:
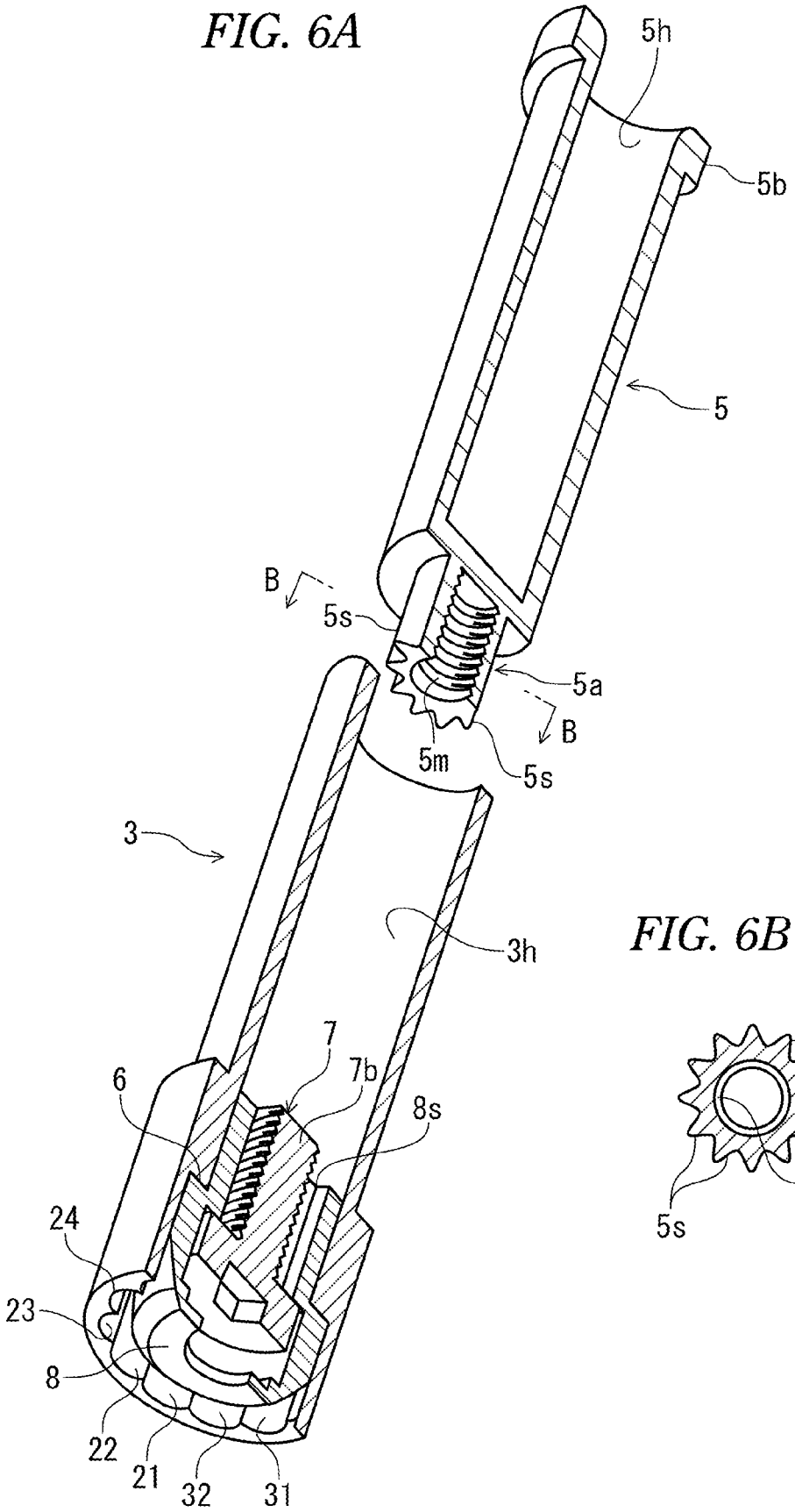
FIG. 6A is a perspective cross-sectional view of the hosel and a shaft case.
Figure 6B:
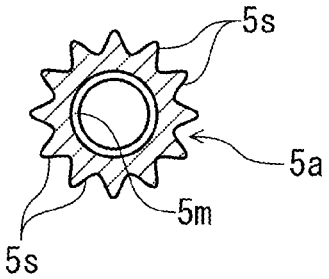
FIG. 6B is a cross-sectional view taken along the line B-B of FIG. 6A.

When making the shaft case 5 inserted most shallowly, the spacer 30 is fit to the shaft case 5, and the shaft case 5 of the shaft case-shaft connected body is inserted into the hosel column 3 as shown in FIGS. 3, 4, and 6. In addition, the bolt holder 8 is inserted into the hosel column 3 from the lower end of the hosel column 3, and the convex corner portions 8*t* are engaged with the concave threads 21, 24, 27, and 30. Then, the bolt 7 is screwed into the female screw hole 5*m* of the shaft case 5.

Thus, the convex corner portions 8*t* of the bolt holder 8 are pressed strongly against the step face 6, the spacer 30 is sandwiched between the upper end face of the hosel column 3 and the flange member 5*b*, and the shaft case 5 is fixed to the head 1 as shown in FIGS. 1A and 3. Because the shaft case 5 is strongly bonded to the shaft 4 with the adhesive agent, the golf club having a configuration that the shaft 4 and the head 1 are of a monolithic construction is brought to completion. Because the splines 5*s* of the shaft case 5 are engaged with the splines 8*s* of the bolt holder 8, the phase of a circumferential direction of the shaft 4 and the shaft case 5 is precisely determined. In addition, the shaft 4 and the shaft case 5 possess high fixation stiffness in a torque direction.

The length in the axial direction of the spacer 30 and the distance between the step face 6 and the concave thread upper ends 23*t*, 26*t*, 29*t*, and 32*t* are same, and the spacer 30 is sandwiched between the flange member 5*b* and the upper end face of the hosel column 3. It is preferable that a washer made from rubber or a synthetic resin intervene at least one of between an upper end face of the spacer 30 and the flange member 5*b*, and between the upper end face of the hosel column 3 and a lower end face of the spacer 30. It is also preferable that the spacer 30 be made from rubber or a synthetic resin.

In the present invention, the spacer 30 is removed as shown in FIGS. 1A and 4, and the convex corner portions 8*t* of the bolt holder 8 are engaged with the concave threads 22, 25, 28, and 31 to be brought into contact with the concave thread upper ends 22*t*, 25*t*, 28*t*, and 31*t*, and thereby the insertion depth of the shaft case 5 into the hosel column 3 can be made largest. Thus, the golf club has the shortest shaft from the standpoint of appearance.

By replacing the spacer 30 with the spacer that is half the length of the spacer 30 in the axial direction (not shown in the drawings), and engaging the convex corner portions 8*t* of the bolt holder 8 with the concave threads 23, 26, 29, and 32 to bring the convex corner portions 8*t* into contact with the concave thread upper ends 23*t*, 26*t*, 29*t*, and 32*t*, the insertion depth of the shaft case 5 into the hosel column 3 can be changed into the intermediate depth. Thus, the golf club has the shaft having an intermediate length that is between the largest length and the smallest length from the standpoint of appearance.

In the present invention, a shaft change in the golf club can also be made easily. In making a shaft change, a shaft case of a pattern identical to the shaft case 5 is bonded in advance with an adhesive agent to a new shaft to be replaced with.

By unbolting the bolt 7 of the existing golf club, the existing shaft 4 is removed together with the existing shaft case 5 from the head 1. Then, the new shaft attached with the shaft case (the shaft case-shaft connected body) is inserted into the head 1 to be fixed by the bolt 7.

As described above, the shaft attachment and the shaft change can be made very easily and promptly. In making a shaft change in a conventional golf club, a hosel portion of the existing golf club is heated to destroy a structure made from a cured adhesive agent to pull the shaft out of the hosel hole, and a new shaft is bonded with an adhesive agent, so that it takes a few hours to one day; however, in the above-described embodiment of the present invention, the shaft case 5 is attached in advance to the new shaft with the adhesive agent, so that the shaft change can be made within a few minutes. Thus, by preparing shafts of a variety of specifications that are attached with shaft cases, a method for using a golf club to make trial shots by attaching different shafts one by one to the identical head 1 can be achieved.

In the present embodiment, the axis center of the shaft insertion hole 5*h* is oblique to the axis center of the outer periphery of the shaft case 5, that is, the axis center of the hosel column 3 as shown in FIG. 8, so that the inclination of the shaft 4 is changeable. To be specific, an axis center line $a_1$ of the outer periphery of the shaft case 5 is oblique with respect to an axis center line $a_2$ of the shaft insertion hole 5*h* at an angle θ. In the usual case, the angle θ is preferably about 0.1 to 5 degrees, and more preferably about 0.25 to 3 degrees.

It is to be noted that the axis center lines do not have to intersect each other, and may have a "twisted" relation. That is, the axis center lines may have a relation such that the axis center lines do not intersect each other while one of the axis center lines passes through the vicinity of the other axis center line.

Rotating the shaft case 5 90 degrees, 180 degrees, or 270 degrees in the circumferential direction of the hosel column 3 allows the inclination direction of the shaft 4 to be changed.

To be specific, the shaft 4 can be adjusted so as to be inclined to the toe side or the heel side, or inclined to the face side or the back side.

Changing the inclination direction of the shaft 4 in this manner changes a lie angle and a slice angle.

A description of the lie angle is provided. The lie angle is smallest when the shaft 4 is inclined most to the heel side, and defines the flattest lie angle. The lie angle when the shaft 4 is inclined to the tow side defines the most upright lie angle.

A description of the slice angle is provided. The state where the shaft 4 faces the toe side defines a normal state. When the shaft 4 is inclined most to the face side, the face is in a hook face state where the face is most closed. In contrast, when the shaft 4 is inclined most in a rear direction, the face is in a slice face state where the face is most open.

As described above, changing the orientation of the shaft case 5 in the circumferential direction allows the inclination direction of the shaft 4 with respect the head 1 to be changed, which allows the lie angle and the slice angle to be changed. In the above description, the orientation of the shaft case 5 is changed in units of 90 degrees; however, because in the present embodiment, the twelve splines 5*s* and the twelve splines 8*s* are provided at intervals of 30 degrees in the circumferential directions, the orientation of the shaft case 5 can be changed in units of 30 degrees. Thus, the golf club can be brought into intermediate states between the above-described states. The specification of the golf club can be finely adjusted to be, for example, "slightly hook face", "slightly slice face", or "slightly upright lie angle".

Figure 9:
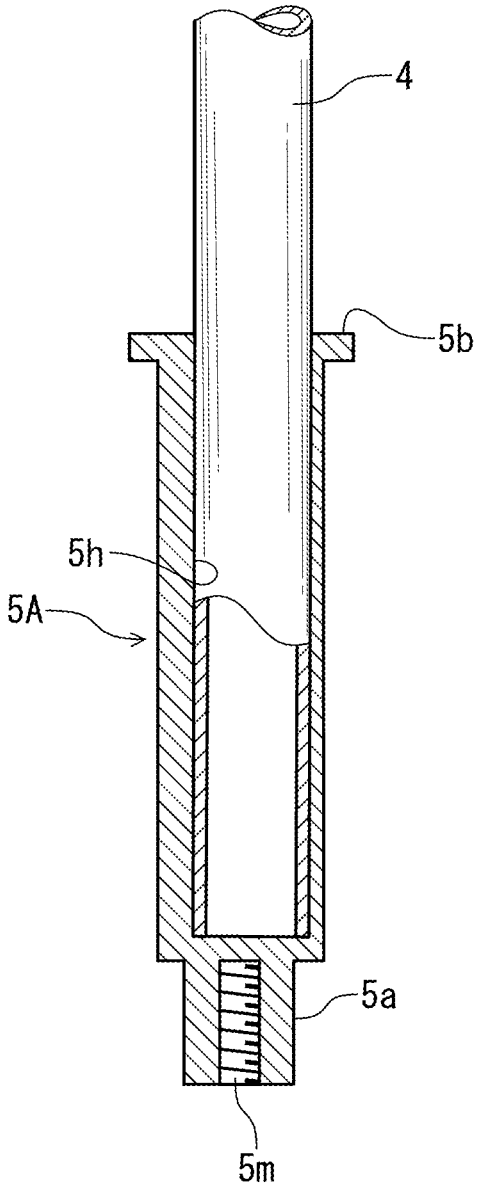
FIG. 9 is a cross-sectional view of a shaft case having another shape.

In the present invention, a shaft case other than the above-described shaft case may be used. A shaft case 5A shown in FIG. 9 has a shaft insertion hole 5*h* that is decentered from an axis center position of the shaft case 5. The axis center of the shaft insertion hole 5*h* is parallel to the axis center of the outer periphery of the shaft case 5, and is slightly apart (e.g., 0.5 to 4 mm apart) from the axis center.

Using the shaft case 5A can adjust the progression of the shaft. For example, it is possible to bring the shaft 4 closest to the face side, or to change the position of the shaft 4 in a parallel translation manner to the heel side, back side, or the toe side by pulling the shaft case 5A once from the hosel column 3 by unbolting the bolt 7 from the state where the shaft 4 is closest to the face side, and rotating the shaft 4 90 degrees, 180 degrees, or 270 degrees. Changing the position of the shaft 4 in this manner allows the distance between the axis center of the shaft and the center of gravity of the head to be changed. In addition, bringing the position of the shaft 4 to the face side or the back side allows the progression to be changed. It is preferable that the above described shaft case, hosel column, bolt and spacer be made from metal, and in particular, it is preferable that the above described shaft case, hosel column, bolt and spacer be made from aluminum or titanium, or an alloy of aluminum or titanium. A shaft case that is made from an aluminum alloy to which alumite treatment is applied to increase the surface hardness so as to improve scratch resistance can be used as the shaft case; however, the present invention is not limited to this configuration. A hosel column that is made from pure titanium and produced by cutting work can be used as the hosel column; however, the present invention is not limited to this configuration. As one example of the present invention, the inner diameter of the upper end of the hosel column 3 is about 10.5 mm, the inner diameter of the lower end of the hosel column 3 is about 8.5 mm, and the diameter of the threaded shaft portion of the bolt 7 is about 4 to 5 mm; however, the present invention is not limited to these configurations.

The material from which the head is made is not limited particularly; however, in the case of a wood-type golf club head, the club can be made from, for example, a titanium alloy, an aluminum alloy, or a stainless steel. It is preferable that a titanium alloy used in the face be of low specific gravity such as a titanium alloy of Ti-6A1-1Fe, a titanium alloy of Ti-6A1-2Fe, and a titanium alloy of Ti-6A1-3Fe. These titanium alloys have a specific gravity of about 4.4. Titanium alloys that have a specific gravity of 4.4 are as follows.

Ti-8A1-1V-1Mo (specific gravity 4.37)
Ti-7A1-2V (specific gravity 4.35)
Ti-7.5A1-2V (specific gravity 4.35)
Ti-8A1-1V (specific gravity 4.34)
Ti-8A1-2V (specific gravity 4.35)
Ti-8A1-1V-1Mo-0.15C (specific gravity 4.37)
Ti-6A1-1Fe (specific gravity 4.38)

It is to be noted that a grip that has a non-perfect round shape in cross section is sometimes used as a grip attached to the shaft 4. For example, a lower face of the outer periphery of the grip that is oriented to the ground at address sometimes has the shape expanding more than the other faces. In this case, when the orientation of the shaft case 5, 5A is changed, the expanding portion of the grip is not always oriented to the ground side. In order to solve this problem, it is preferable to use a grip that has a perfect round shape in cross section in the present invention.

In the above-described embodiment of the present invention, the golf club head is of a wood type; however, the present invention can be applied also to a utility-type golf club head that resembles the wood-type golf club head.

In the present invention, it is preferable that a weight member be provided at the heel side of the head. The object of providing the weight member is to cancel out a weight by removing the weight member, the weight being increased when the spacer 30 is provided to increase the club length in the golf club according to the embodiment of the present invention. In addition, another object of providing the weight member is that because increasing the club length could change the swing balance, the weight of the head needs to be reduced to keep the same balance.

Examples of the head with the weight member include a head that is provided with two weight members at a sole portion on the heel side, and two weight members at a side portion; however, the number of the weights is not limited to the number described above. For example, it is also preferable to provide only one weight member to the head. In addition, it is also preferable to provide the weight member only at the sole portion, or only at the side portion.

It is to be noted that in the present invention, changing the face angle or the lie angle changes warpage (orientation) of the head during swing; however, adjusting the weight of the weight member disposed around the shaft can solve this problem.

Figure 10A:
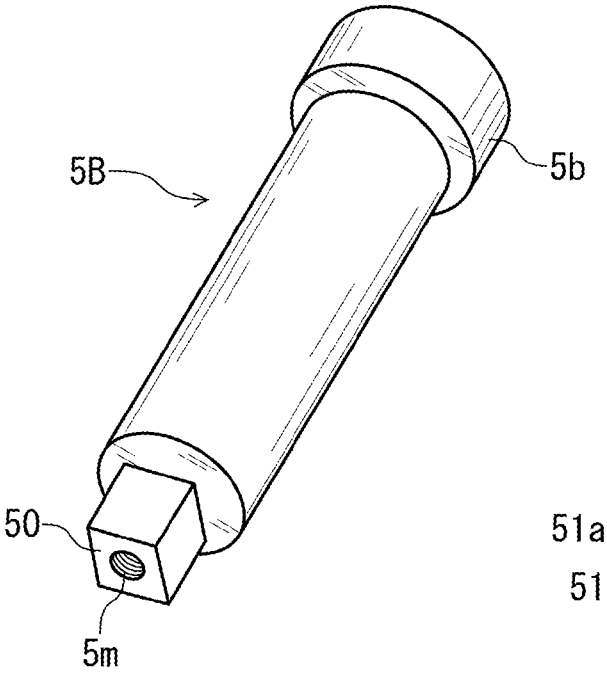
FIGS. 10A and 10B are perspective views of shaft cases having other shapes.
Figure 10B:
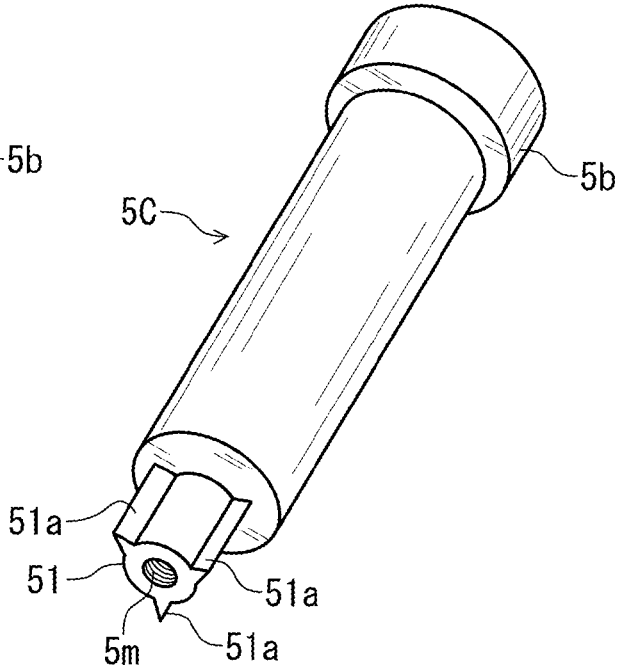

In the present invention, it is also preferable to use a mechanism for effecting positioning in a circumferential direction instead of the splines. One example of the mechanism is shown in FIGS. 10A and 10B. A shaft case 5B shown in FIG. 10A includes a convex axis member 50 that has a quadrangular prism shape or a triangular prism shape (a quadrangular prism shape in the drawing). A shaft case 5C shown in FIG. 10B includes a convex axis member 51 that has a cylindrical shape and includes a plurality of convex threads 51*a* (three threads in this drawing) that are provided on a lateral periphery of the convex axis member 51. Corner edge portions of the quadrangular prism or the triangular prism, and the convex threads 51*a* define a first engaging member. By increasing the number of the concave threads that define the second engaging member provided on the hosel side, in which the corner edge portions of the quadrangular prism or the convex threads 51*a* are to be fitted, two or three fold as much as the number of the corner edge portions or the convex threads, the concave threads can be reduced in weight, and can be fit into the corner edge portions or the convex threads 51*a* because the angle of both the sides of each concave thread becomes smaller than the angle of both the sides of each concave thread in a polygon such as a hexagon and an octagon, which is preferable.

Figure 11:
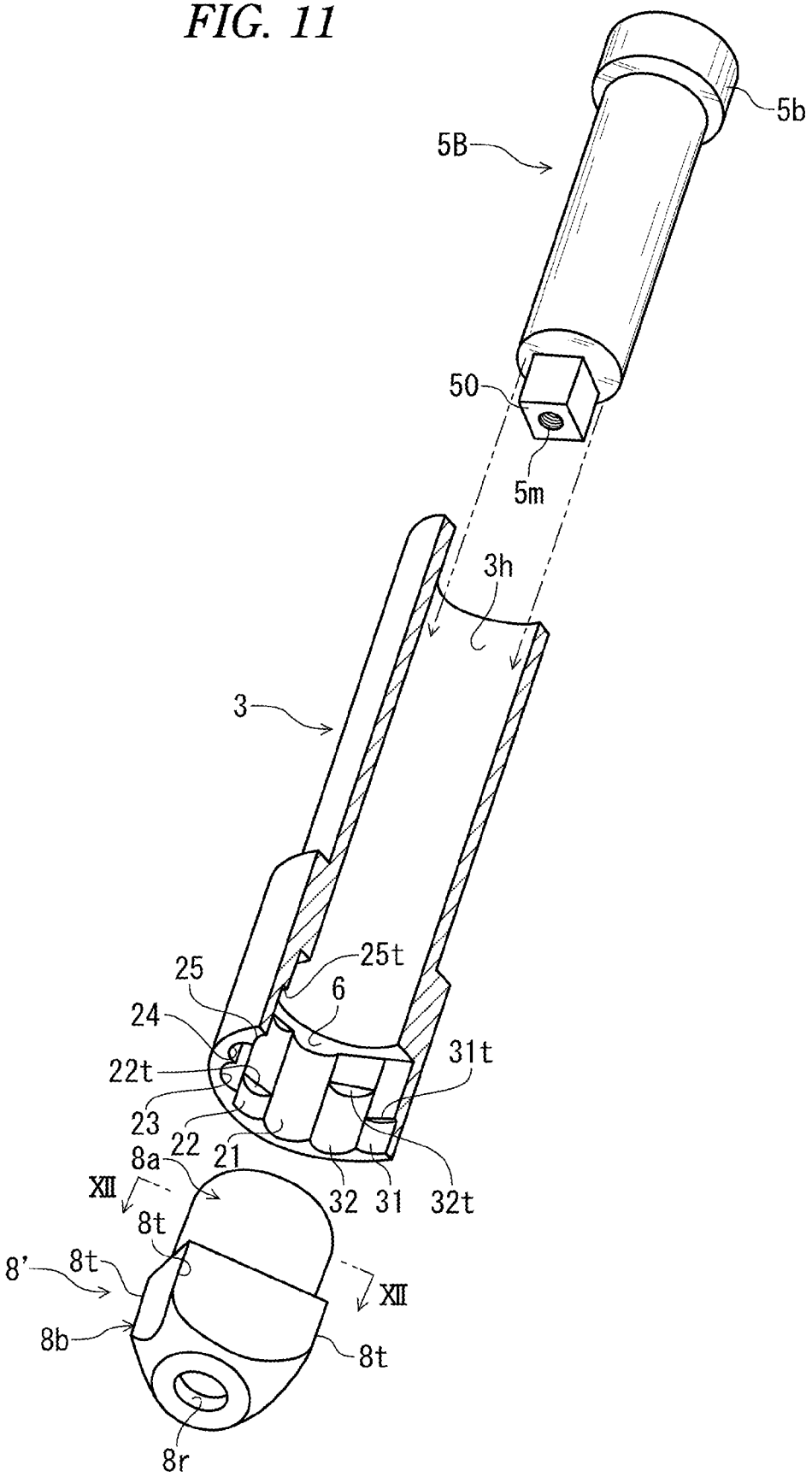
FIG. 11 is an exploded perspective view of the shaft case shown in FIG. 10 showing the mounting structure.
Figure 12A:
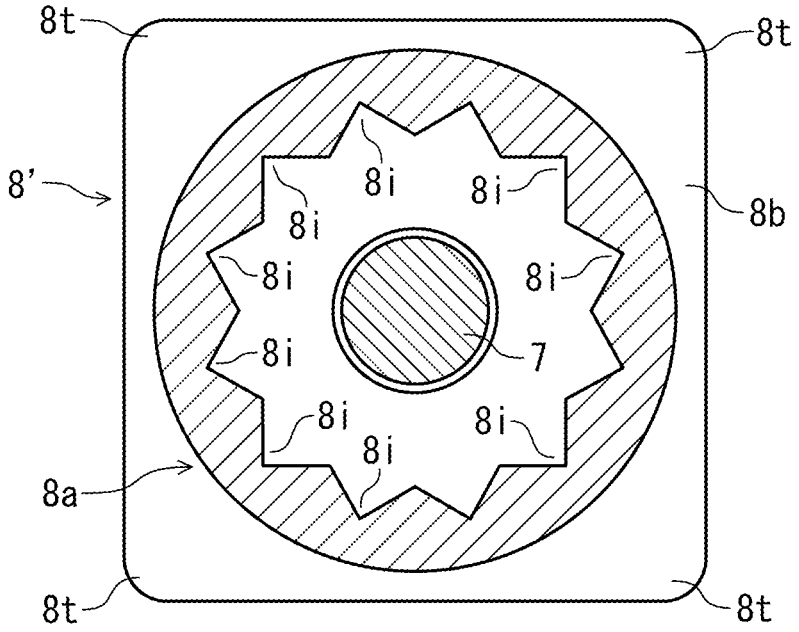
FIGS. 12A and 12B are cross-sectional views taken along the line XII- XII of FIG. 11.
Figure 12B:
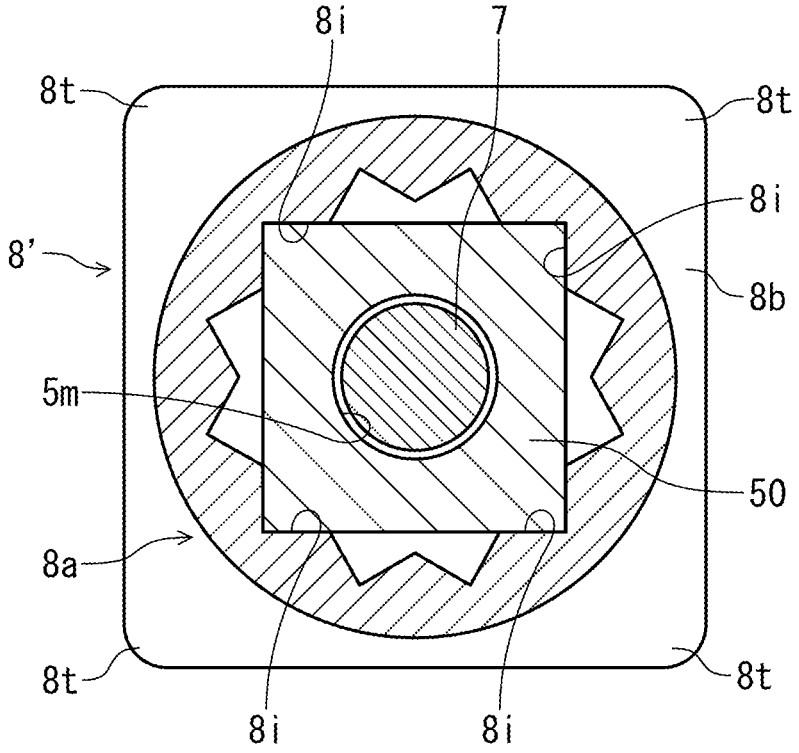

FIG. 11 is an exploded perspective view of the shaft case 5B shown in FIG. 10A, the hosel column 3, and a bolt holder 8' showing an engagement relation between them, and FIGS. 12A and 12B are cross-sectional views taken along the line XII-XII of FIG. 11, where FIG. 12A is a view before the convex axis member 50 is inserted, and FIG. 12B is a view after the convex axis member 50 is inserted. The bolt holder 8' has an inner periphery that has a concave polygonal shape of a dodecagon. That is, twelve concave threads 8*i* that define a second engaging member are provided on the inner periphery of the bolt holder 8' so as to extend in a direction parallel to the axis center line of the bolt holder 8'. The angle of a thread bottom of each concave thread 8*i* is 90 degrees, and the four corner edges of the convex axis member 50 having the quadrangular prism shape engage with the four concave threads 8*i* as shown in FIG. 12B. The convex axis member 50 is capable of engaging with the bolt holder 8' with its orientation changed in units of 30 degrees as clearly shown in FIG. 12B.

While the inner hole of the bolt holder 8' shown in FIGS. 12A and 12B has the concave polygonal shape of a dodecagon, it is also preferable that the inner hole of the bolt holder 8' have a concave polygonal shape of an octagon. In this case, the convex axis member 50 connects with the bolt holder while the orientation of the convex axis member 50 is changed in units of 45 degrees.

Figure 13:
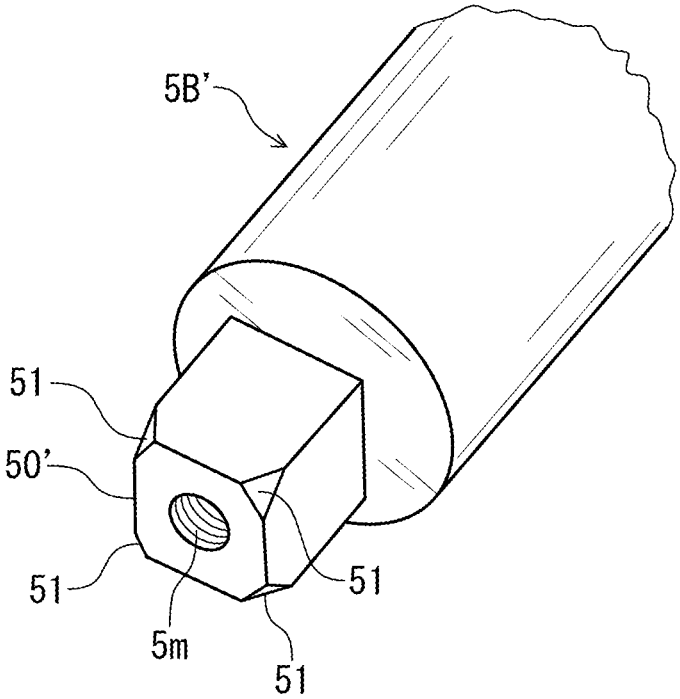
FIG. 13 is a perspective view of a convex axis member having another shape.
Figure 14:
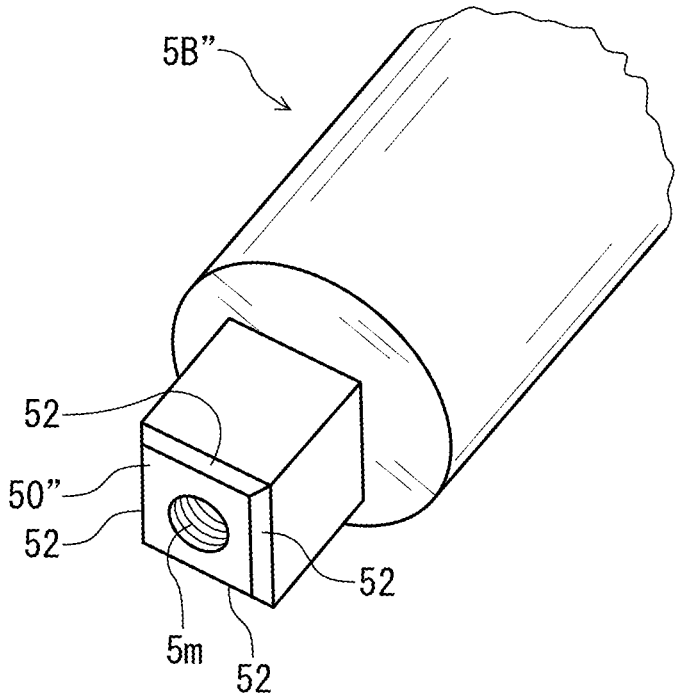
FIG. 14 is a perspective view of a convex axis member having another shape.

In the present invention, it is also preferable to provide a tapered portion to the top end of the convex axis member in order to insert the convex axis member having the quadrangular prism shape more easily into the concave threads Si of the bolt holder. Examples of the tapered portion are shown in FIGS. 13 and 14. A convex axis member 50' of a shaft case 5B' shown in FIG. 13 is provided with tapered portions 51 having a shape such that top end sides of the four thread corner edges of the convex axis member 50' having the quadrangular prism shape are cut at a bevel. A convex axis member 50" of a shaft case 5B" shown in FIG. 14 is provided with tapered portions 52 having a shape such that the entire circumference of a top end face of the convex axis member 50" having the quadrangular prism shape is cut at a bevel.

What is claimed is:

1. A golf club comprising:

a shaft;

a head attached to a leading end of the shaft; and a shaft case having an approximately cylindrical shape, and including a shaft insertion hole which the leading end of the shaft is inserted into and bonded to, an axis center of an outer periphery of the shaft case and an axis center of the shaft being in a non-coaxial state, the shaft case being inserted into an inner hole of a hosel column of the head, the shaft case being fixed to the hosel column with a bolt, wherein:

the shaft case includes a convex axis member provided at a bottom end of the shaft case, the convex axis member including a female screw hole and a first engaging member that is provided on an outer periphery of the convex axis member;

the inner hole of the hosel column has a diameter that is larger on a lower side of a step face that is provided at some midpoint in an axis center direction of the inner hole than at the step face;

the hosel column includes a plurality of concave threads that are provided on the lower side of the step face on an inner periphery of the hosel column, and extend to a lower end of the hosel column, upper ends of some of the plurality of concave threads being disposed lower than the step face;

a bolt holder having a cylindrical shape is provided at a lower portion of the inner hole of the hosel column, the bolt holder being arranged to connect with either one of the step face and the upper ends of the concave threads;

the bolt is disposed within the bolt holder;

a reduced-diameter face is provided at some midpoint in an up and down direction inside of the bolt holder, and the inside of the bolt holder has a diameter that is larger on a lower side of the reduced-diameter face than on an upper side of the reduced-diameter face;

a head portion of the bolt is in contact with the reduced-diameter face from the lower side, and a threaded shaft portion of the bolt extends upper than the step face to screw into the female screw hole;

a second engaging member is provided on the upper side of the reduced-diameter face on an inner periphery of the bolt holder, the second engaging member being arranged to be engaged with the first engaging member to prevent the shaft case from rotating;

a flange member is provided at a top end of the shaft case, and a spacer is provided insertable and removable between the flange member and an upper end of the hosel column;

the bolt holder is arranged to connect with the step face when the spacer is inserted between the flange member of the shaft case and the hosel column; and the bolt holder is arranged to connect with the upper ends of the concave threads when the spacer is removed.

2. The golf club according to claim 1, wherein the concave threads include a plurality of concave threads, of which positions of upper ends in an axis center line direction of the hosel column are different from each other.

3. The golf club according to claim 1, wherein convex corner portions are provided on an outer periphery of the bolt holder, the convex corner portions being arranged to be engaged with either one of the step face and the upper ends of the concave threads.

4. The golf club according to claim 1, wherein the axis center of the shaft is in a slanting direction with respect to the axis center of the outer periphery of the shaft case.

5. The golf club according to claim 1, wherein the axis center of the shaft is parallel to the axis center of the outer periphery of the shaft case.

6. The golf club according to claim 1, wherein the head includes a weight member provided on a heel side of the head.

7. A golf club comprising:

a shaft;

a head attached to a leading end of the shaft; and a shaft case having an approximately cylindrical shape, and including a shaft insertion hole which the leading end of the shaft is inserted into and bonded to, an axis center of an outer periphery of the shaft case and an axis center of the shaft being in a non-coaxial state, the shaft case being inserted into an inner hole of a hosel column of the head, the shaft case being fixed to the hosel column with a bolt, wherein:

the shaft case includes a convex axis member provided at a bottom end of the shaft case, the convex axis member including a female screw hole and a first engaging member that is provided on an outer periphery of the convex axis member;

the inner hole of the hosel column has a diameter that is larger on a lower side of a step face that is provided at some midpoint in an axis center direction of the inner hole than at the step face;

the hosel column includes a plurality of concave threads that are provided on the lower side of the step face on an inner periphery of the hosel column, and extend to a lower end of the hosel column, upper ends of some of the plurality of concave threads being disposed lower than the step face;

a bolt holder having a cylindrical shape is provided at a lower portion of the inner hole of the hosel column, the bolt holder being arranged to connect with either one of the step face and the upper ends of the concave threads;

the bolt is disposed within the bolt holder;

a reduced-diameter face is provided at some midpoint in an up and down direction inside of the bolt holder, and the inside of the bolt holder has a diameter that is larger on a lower side of the reduced-diameter face than on an upper side of the reduced-diameter face;

a head portion of the bolt is in contact with the reduced-diameter face from the lower side, and a threaded shaft portion of the bolt extends upper than the step face to screw into the female screw hole;

a second engaging member is provided on the upper side of the reduced-diameter face on an inner periphery of the bolt holder, the second engaging member being arranged to be engaged with the first engaging member to prevent the shaft case from rotating;

a flange member is provided at a top end of the shaft case, and a spacer is provided insertable and removable between the flange member and an upper end of the hosel column;

the bolt holder is arranged to connect with the step face when the spacer is inserted between the flange member of the shaft case and the hosel column;

the bolt holder is arranged to connect with the upper ends of the concave threads when the spacer is removed;

the concave threads include a plurality of concave threads, of which positions of upper ends in an axis center line direction of the hosel column are different from each other; and convex corner portions are provided on an outer periphery of the bolt holder, the convex corner portions being arranged to be engaged with either one of the step face and the upper ends of the concave threads.

8. The golf club according to claim 7, wherein the axis center of the shaft is in a slanting direction with respect to the axis center of the outer periphery of the shaft case.

9. The golf club according to claim 7, wherein the axis center of the shaft is parallel to the axis center of the outer periphery of the shaft case.

10. The golf club according to claim 7, wherein the head includes a weight member provided on a heel side of the head.

* * * * *